US005338219A

United States Patent [19]

Hiramoto et al.

[11] Patent Number: 5,338,219

[45] Date of Patent: Aug. 16, 1994

[54] ELECTRIC CONNECTOR

[75] Inventors: Haruo Hiramoto; Tomoaki Ito; Katsutoshi Tojo, all of Machida, Japan

[73] Assignee: Molex Incorporated, Lisle, Ill.

[21] Appl. No.: 87,936

[22] Filed: Jul. 6, 1993

[30] Foreign Application Priority Data

Jul. 23, 1992 [JP] Japan ..... 4-057339[U]

[51] Int. Cl.[5] ..... H01R 13/627

[52] U.S. Cl. ..... 439/350; 439/357

[58] Field of Search ..... 439/216, 217, 345, 350, 439/353, 354, 357, 358

[56] References Cited

U.S. PATENT DOCUMENTS

| | | | |
|---|---|---|---|
| 3,399,374 | 8/1968 | Pauza et al. | 439/355 |
| 3,409,858 | 11/1968 | Krehbiel | 439/354 |
| 4,406,509 | 9/1983 | Jagen | 439/354 |
| 4,810,855 | 3/1989 | Dassi et al. | 439/217 X |
| 4,867,699 | 9/1989 | Oda et al. | 439/350 X |
| 4,900,261 | 2/1990 | Gentry et al. | 439/357 X |
| 5,021,003 | 6/1991 | Ohtaka et al. | 439/357 |
| 5,112,243 | 5/1992 | Chow et al. | 439/352 |
| 5,119,547 | 6/1992 | Ii | 29/764 |
| 5,192,225 | 3/1993 | Suzuki | 439/350 X |
| 5,244,402 | 9/1993 | Pasterchick, Jr. et al. | 439/217 |

FOREIGN PATENT DOCUMENTS

| | | | |
|---|---|---|---|
| 0382344 | 8/1990 | European Pat. Off. | 439/354 |

*Primary Examiner*—Khiem Nguyen

*Attorney, Agent, or Firm*—Stephen Z. Weiss

[57] ABSTRACT

An electric connector assembly including female connector having terminals mounted therein and a male connector mateable with the female connector having terminals mounted therein for mating engagement with the terminals of the male connector. Latch means are formed on the female connector housing and interengaging latch means are formed on the male connector housing, both the latch means and interengaging latch means cooperating with each other to selectively latch said connectors together in a mating relationship. The interengaging latch means for the male connector is chosen from a plurality of different interengaging latch means distinguished from one another in that each respective interengaging latch means of one different male housing is different from the interengaging latch means of another different male housing.

4 Claims, 6 Drawing Sheets

ELECTRIC CONNECTOR

FIELD OF THE INVENTION

The present invention relates to an electric connector assembly having two mating housings, one housing having latch means and the second housing having interengaging latch means which are chosen from a plurality of different interengaging latch means whereby a common first housing may permit interengagement with a second housing having anyone of a multiple of interengaging latch means.

BACKGROUND OF THE INVENTION

There are a variety of electric connectors each comprising male and female housings whose terminals will mate with each other when the housings in which they are held are mated and locked together. One kind of electric connector uses a non-manipulated type latching system which is designed to use friction between the latching components of the male and female housings. The other kind of electric connector uses a manipulated type latching system which is designed to positiviely lock and unlock the male housing from the female housing with the aid of an associated finger-manipulated pivoting arm.

Male and female housings equipped with a non-manipulated, automatic type latching system can be mated together while male and female housings equipped with a manipulated non-automatic type latching system can be mated together. However, components of an automatic latching type system cannot be mated with components of a non-automatic latching type system.

In other words male housings with either automatic or non-automatic type latching system components have no female housings in common into which both male housings can lock. If an automatic latching type male connector is to be replaced by a non-automatic latching type male connector or vice versa, it is necessary that a completely new mating female connector having the same type latching system must also be changed. Changing both mating male and female housing involve additional cost since extra connector housings must be maintained in inventory and two molds for molding female housings having both types of latching systems must be built and maintained.

In view of this, one object of the present invention is to provide a female electric connector having latching means which permit alternative mating of an automatic latching type male housing or a non-automatic latching type male housing with a common female housing.

Another object of the present invention is to provide an electric connector which permits substantial reduction of the manufacturing cost of female housings.

SUMMARY OF THE INVENTION

To attain these objects, an electric connector assembly is provided including a first connector having a housing with terminals mounted therein and a second connector mateable with the first connector also having terminals mounted therein for mating engagement with the terminals of the first connector. Latch means are formed on the first connector housing and interengaging latch means are formed on said second connector housing where both latch means cooperate with each other to selectively latch the connectors together in a mating relationship. The second connector housing is chosen from a plurality of different housings distinguished from one another in that each respective interengaging latch means of one different housing is different from the interengaging latch means of another different housing where each of the second connector latch means of the different housings cooperate with the latch means of the first connector housing.

According to a second aspect of the invention, the first connector housing is female and the second connector housing is male with walls of the male connector housing adapted to extend within walls of the female connector housing. The female connector housing has both an aperture formed through the walls and at least one latching projection formed upon the walls. The male connector is chosen from two different housings distinguishable from one another in that one male housing has a latching projection with front and rear slopes adapted to be removably held in the aperture and that the other male housing has a longitudinal pivoting arm adapted to lock onto the latching projection.

According to another aspect of the invention, the aperture in the walls of the female housing may have a slot cut into the wall through one edge of the aperture to increase the flexibility of the aperture in yielding to the latching projection with front and rear slopes. The aperture may also be located between a multiple of latching projections and the longitudinal pivoting arm may have lateral projections which lock onto the multiple latching projections.

BRIEF DESCRIPTION OF THE DRAWING

Other objects and advantages of the present invention will be understood from the following description of electric connectors according to preferred embodiments of the present invention.

DESCRIPTION OF PREFERRED EMBODIMENTS

Figure 1:
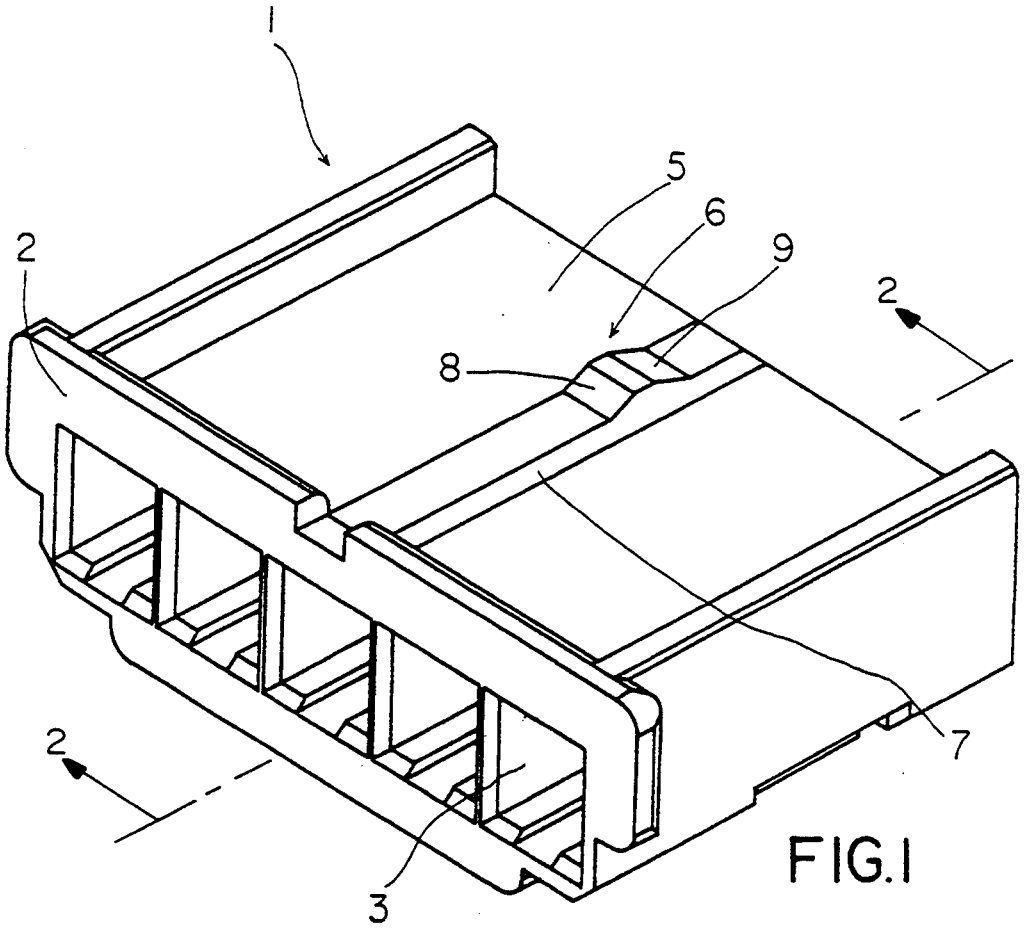
FIG. 1 is a perspective view of an automatic locking type male housing.
Figure 2:
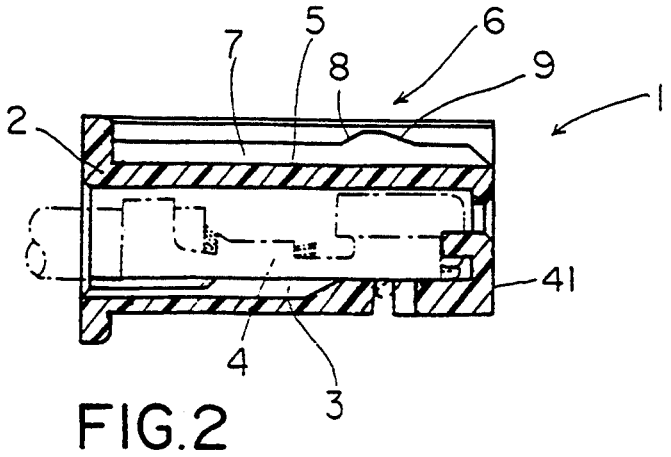
FIG. 2 is a longitudinal section of the automatic locking type male housing taken along the line 2—2 in FIG. 1, showing a terminal held therein in phantom line.

Referring to FIGS. 1 and 2, an automatic non-manipulated latching type male housing 1 has a plurality of longitudinal terminal holes 3 arranged laterally in its body 1. As shown in phantom line in FIG. 2, a terminal 4 an be held in each terminal hole 3. A non-manipulated type latching projection 6 is formed on a longitudinal strip 7 integrally connected to the upper surface 5 of the housing body 2. The latching projection 6 includes a front lock steep slope 8, a consecutive flat top and a rear guide gentle slope 9.

Figure 3:
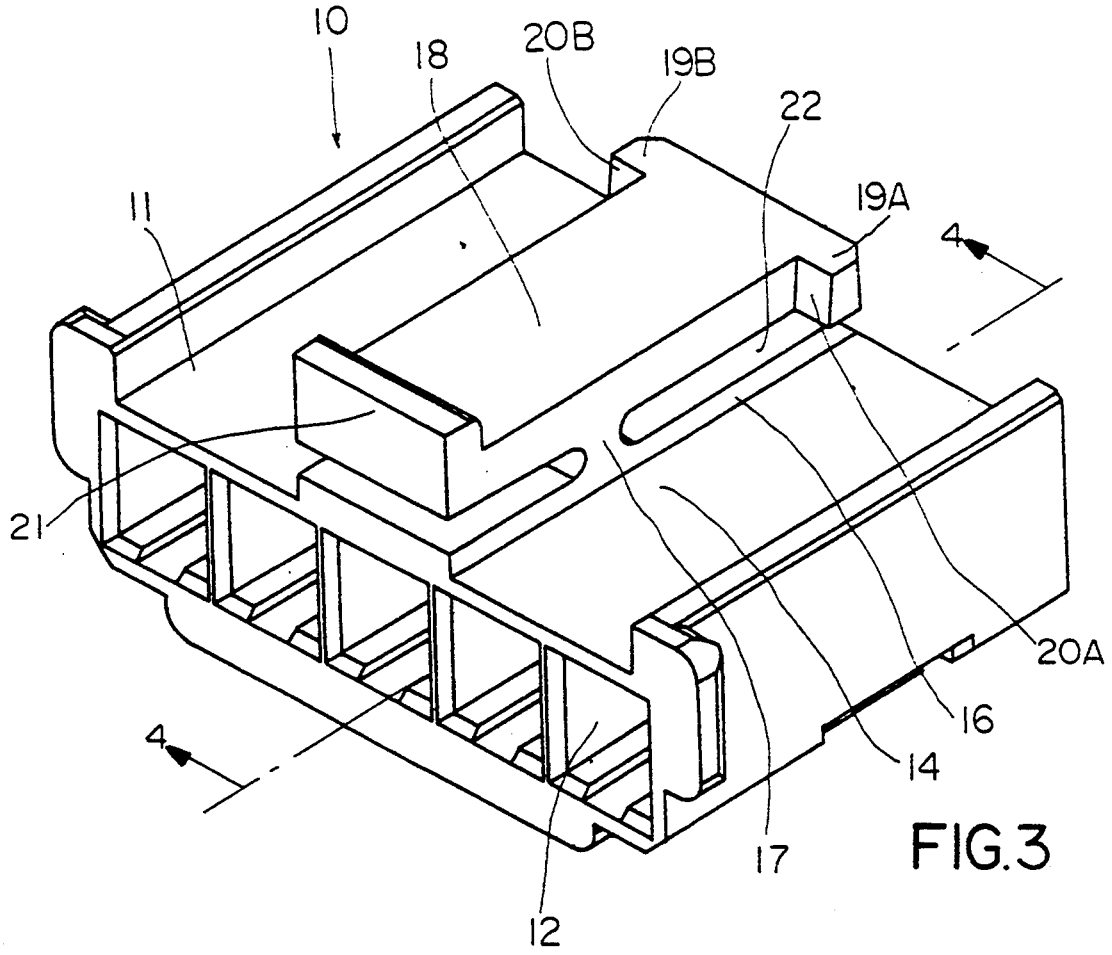
FIG. 3 is a perspective view of a non-automatic locking type male housing.
Figure 4:
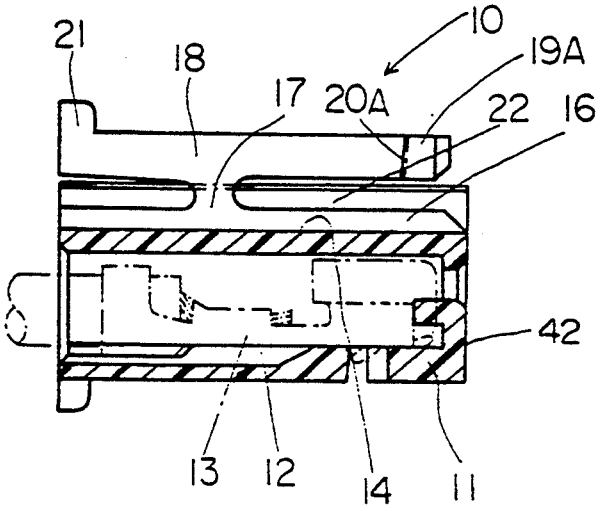
FIG. 4 is a longitudinal section of the non-automatic locking type male housing taken along the line 4—4 in FIG. 3, showing a terminal held therein in phantom line.

Referring to FIGS. 3 and 4, a non-automatic manipulated latching type male housing 10 has a plurality of longitudinal terminal holes 12 arranged laterally in its body 11. As shown in phantom line in FIG. 4, a terminal 13 can be held in each terminal hole 12. Longitudinal arm 18 extends from and is formed integral with the flexible support 17 which is integrally formed with a longitudinal strip 16. An operating knob 21 rises from the front end of the longitudinal arm 18 and projections 19A and 19B extend laterally from the rear end of the longitudinal arm 18. These lateral projections 19A and 19B have locking surfaces 20A and 20B respectively.

In its at rest state, the longitudinal arm 18 is parallel to strip 16. When the operating knob 21 is lowered toward strip 16 by a finger, the longitudinal arm 18 will rotate about the support 17 and raise the lateral projections 19A and 19B. When the operating knob 21 is released, the longitudinal arm 18 will rotate back to its at rest state parallel to strip 16 by the forces stored in flexible support 17. The upper surface of the longitudinal strip 16 and the lower surface of the longitudinal arm 18 define a gap 22, which provides enough clearance to allow the insertion of the ceiling plate 27 of a female housing 23 within the gap when the female housing 23 is mated with the male housing 10.

Figure 5:
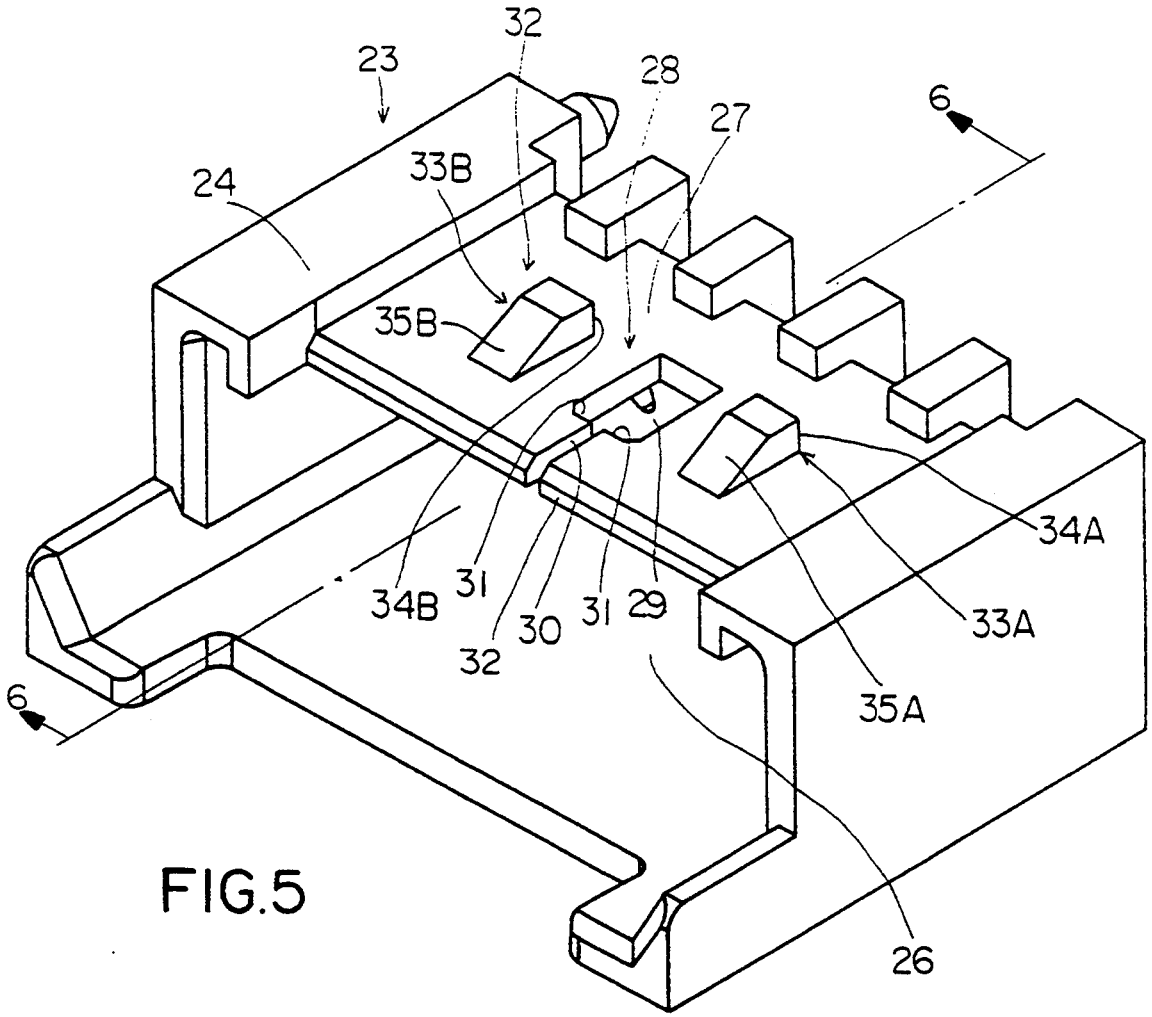
FIG. 5 is a perspective view of a female housing.
Figure 6:
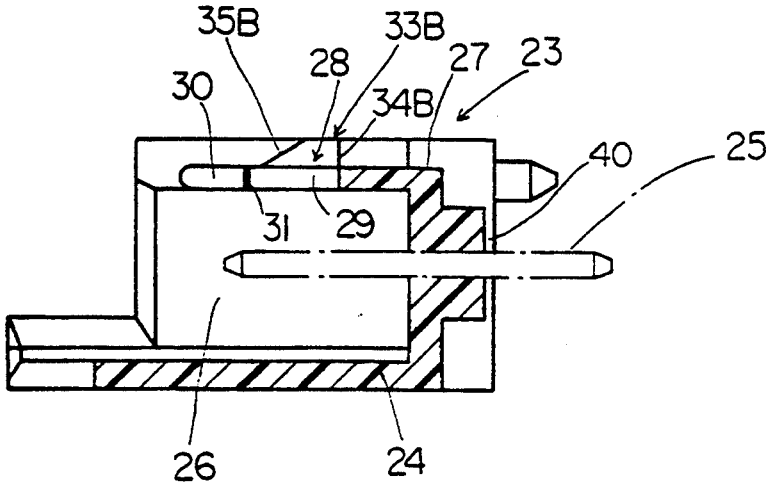
FIG. 6 is a longitudinal section of the female housing taken along the line 6—6 in FIG. 5, showing a terminal in phantom line.

Referring to FIGS. 5 and 6, the female housing 23 has a plurality of terminals 25 fixed to the rear wall 46 of the housing body 24 and projecting in the hollow space 26, as explained below the female housing 23 can accommodate either the automatic or the non-automatic latching type male housings 1 and 10 with the terminals 4 and 13 kept in contact with the terminals 25 projecting in the space 26. The body 24 of the female housing 23 has a catch-and-hold aperture 28 made in its ceiling plate 27 which partially uses friction to catch and hold the latching projection 6 of the automatic latching type male housing 2. A longitudinal slot 30 is cut, extending from the front edge 32 of the ceiling plate 27 to the front lower surfaces 31 of the aperture 28.

The female housing body 24 has a pair of locking projections 33A and 33B built on the upper surface of the ceiling plate 27 to lock the opposite lateral projections 19A and 19B of the longitudinal arm 18 of the non-automatic latching type male housing 10. Each locking projection comprises a steep front slope 35A, 35B, a flat top and a rear erect wall 34A, 34B. During mating of the non-automatic male housing with the female housing the lateral projections 19A and 19B of the longitudinal arm 18 will first ride up the slopes 35A, 35B causing the arm to rotate out of its at rest position. Continued movement to the fully mated condition causes the lateral projections 19A, 19B to be caught by the rear erect walls 34A and 34B of the locking projections 33A and 33B thereby positively locking the male and female housings together.

Figure 7:
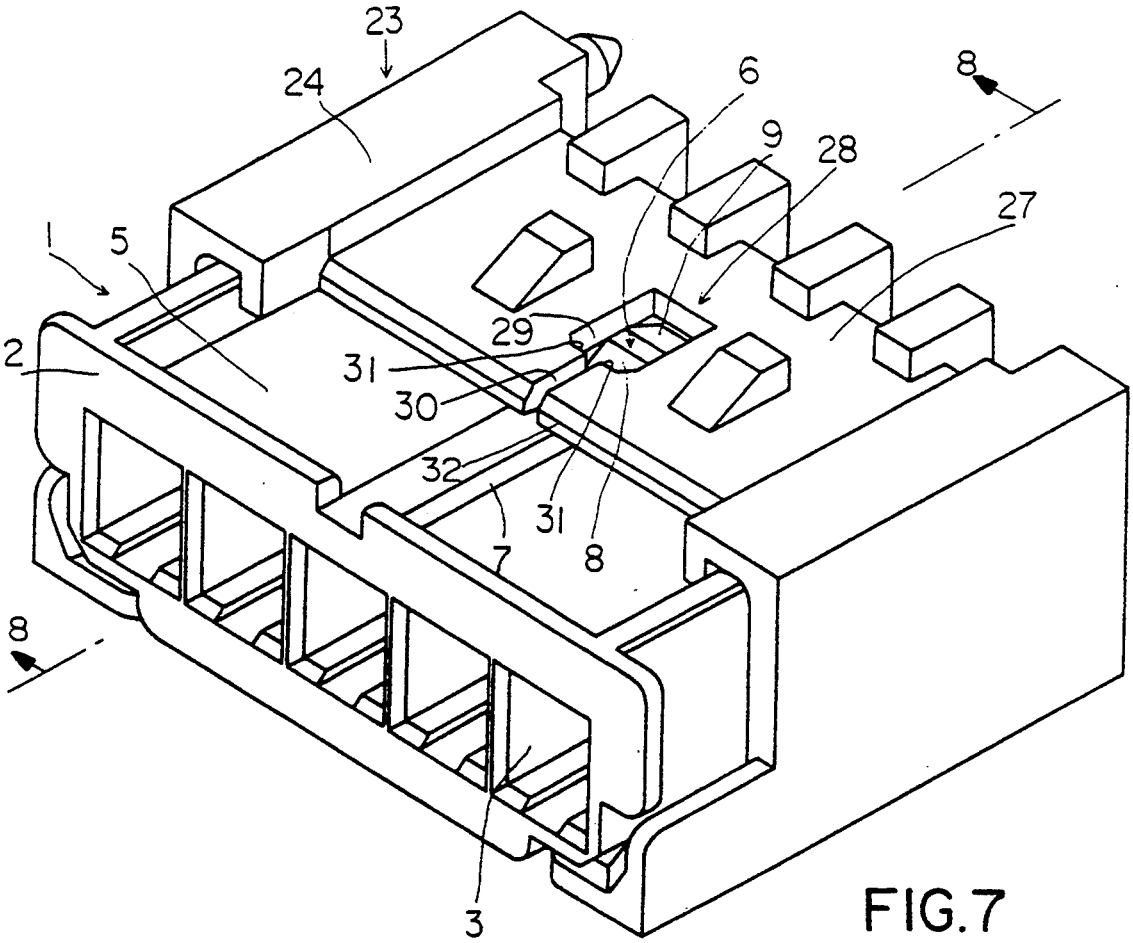
FIG. 7 is a perspective view of the automatic latching type male housing fully mated with the female housing.
Figure 8:
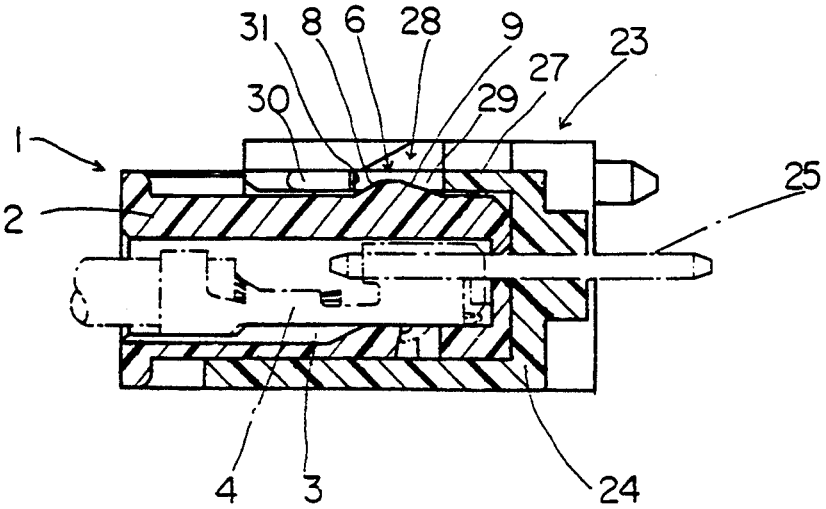
FIG. 8 is a longitudinal section of the male and female housings mated together taken along the line 8—8 in FIG. 7, showing a terminal in phantom line.

Referring to FIGS. 7 and 8, the manner in which the automatic latching type male housing 1 is mated with the female housing 23 in a locking position is described. The rear side 41 of the male housing 1 is pushed into the hollow space 26 of the female housing 23 forcing the guide slope 9 of the latching projection 6 against the front edge 32 of the ceiling plate 27 of the female housing 23. This will raise the front edge 32 of the ceiling plate 27. The center slit 30 permits the front edge 32 to more easily allow the latching projection 6 of the male housing 1 to advance toward the aperture 28. Upon completion of insertion of the male housing 1 into the female housing 23, the latching projection 6 snaps into aperture 28 and the terminals 4 are fully mated with terminals 25. At that fully mated position, the front lock steep slope 8 of the latching projection 6 is kept in contact with the front locking surfaces 31 of the aperture 28 in the ceiling plate 27, thereby preventing the latching projection 6 from slipping out of the aperture 28, when an undesired force below a predetermined amount is applied to the male housing 1.

When it is desired to disengage the male housing 1 from the female housing 23, a force above a predetermined amount is applied to the male housing 1 in a direction away from the female housing 23. This will cause the front lock steep slope 8 of the latching projection 6 to force the front wall 31 of the aperture 28 to raise somewhat. The center slit 30 allows the front edge 32 of the ceiling plate 27 to raise more easily so that the latching projection 6 of the male housing 1 can slip out of the aperture 28, thus permitting disengagement of the male housing 1 from the female housing 23.

Figure 9:
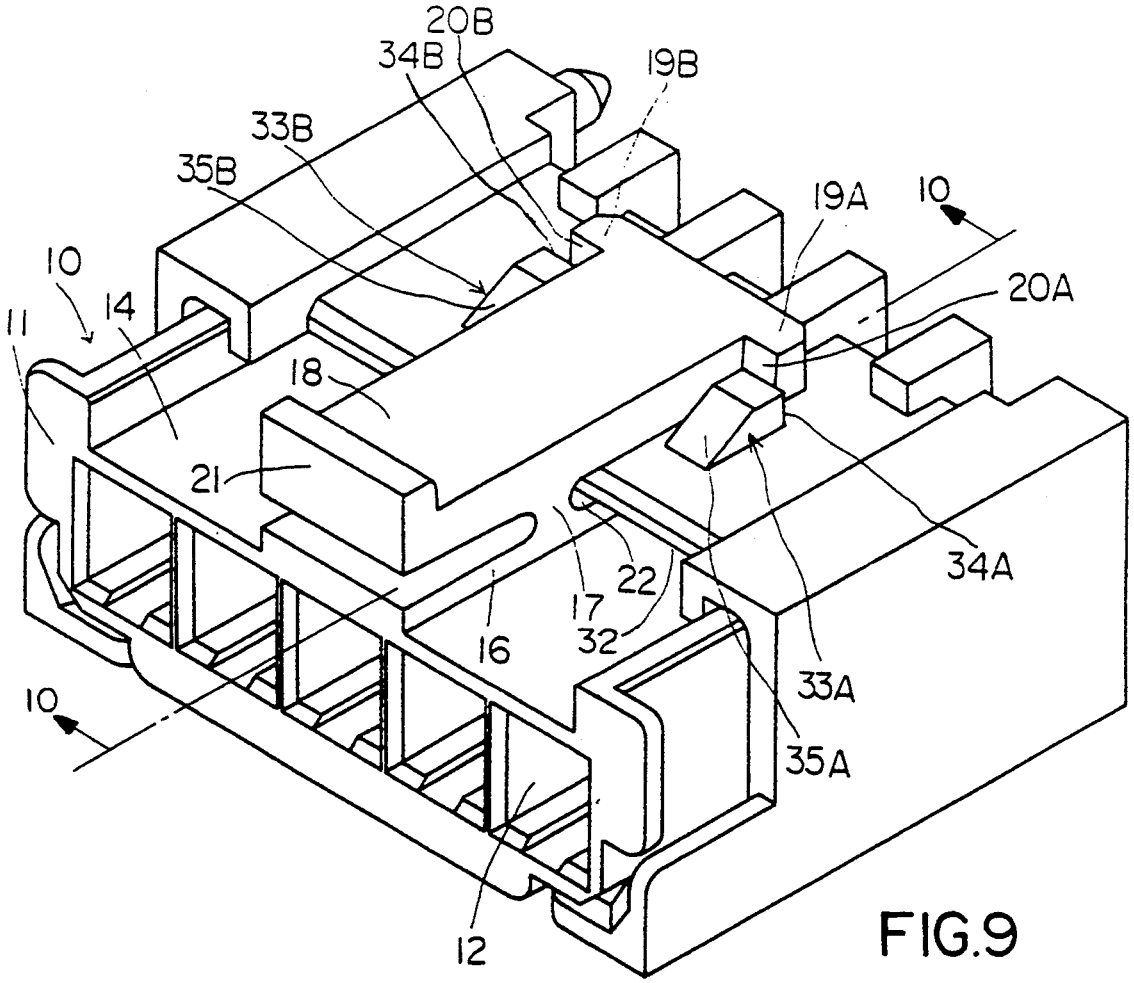
FIG. 9 is a perspective view of the non-automatic latching type male housing fully mated with the female housing.
Figure 10:
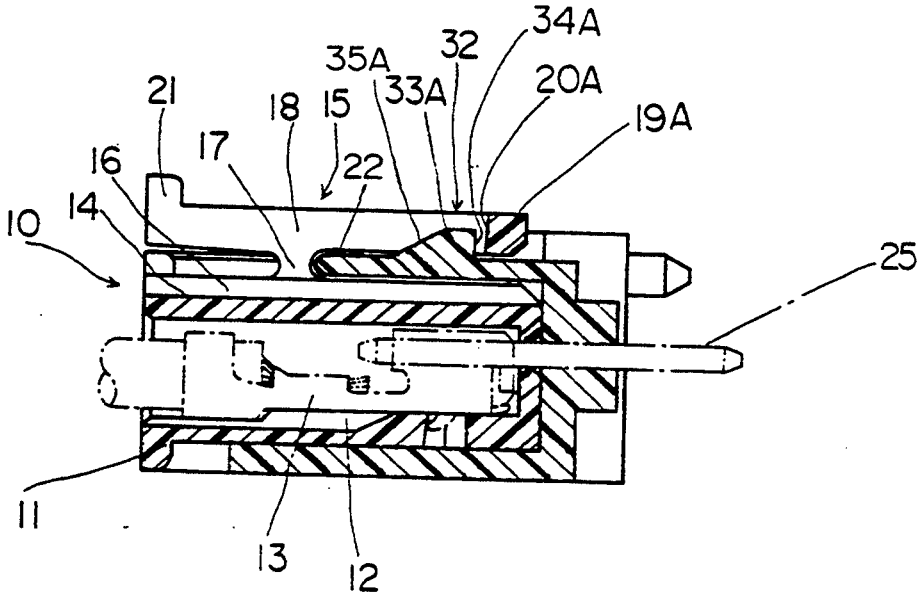
FIG. 10 is a longitudinal section of the male and female housings mated together taken along the line 10—10 in FIG. 9, showing terminals in phantom line.

Referring to FIGS. 9 and 10, the manner in which the non-automatic latching type male housing 10 is mated with the female housing 23 into a locking position is described. The rear side 42 of the male housing body 11 is pushed in the hollow space 26 of the female housing 23 with the front edge 32 of the ceiling plate 27 of the female housing body 24 inserted into the gap 22 of the male housing 10. In the course of insertion the lateral projections 19A and 19B of the longitudinal arm 18 climb the slopes 35A and 35B of a pair of locking projections 34A and 34B, causing the longitudinal arm 18 to rotate about its support 17 out of its at resting position. Further insertion of the male housing 10 into the female housing 23 will cause the lateral projections 19A and 19B to ride over and fall behind the locking projections 33A and 33B, thus permitting the lateral projections 19A and 19B to be caught by the rear erect walls 34A and 34B of the locking projections 33A and 33B, whereby the terminals 13 of the male housing 10 will be in mating contact with the terminals 25 of the female housing 23.

When it is desired that the male housing 10 be unlocked from the female housing 23, the thumb knob 21 is pushed down with a finger or thumb causing the longitudinal arm 18 to rotate until its lateral projections 19A and 19B rise above the rear erect walls 34A and 34B of the locking projections 33A and 33B. Thereafter the male housing 10 may be pulled away from the female housing 23.

Figure 11:
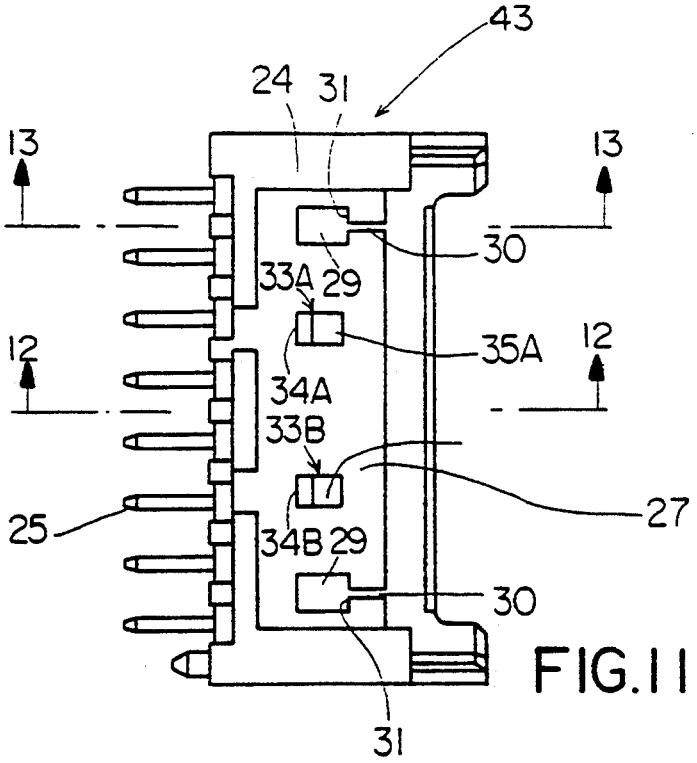
FIG. 11 is a plane view of a female housing according to another embodiment of the present invention.
Figure 14:
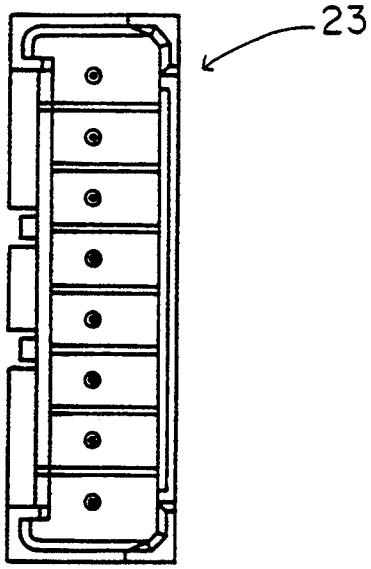
FIG. 14 is a front view of the female housing of FIG. 11.
Figure 12:
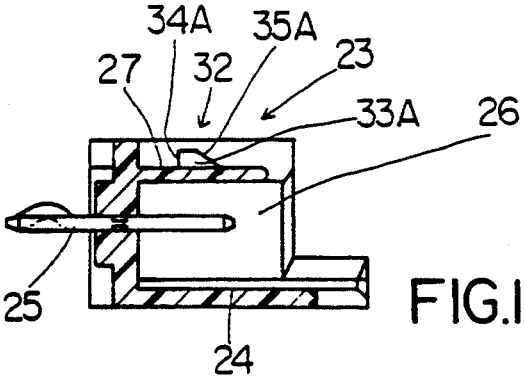
FIG. 12 is a section of the female housing taken along the line 12—12 in FIG. 11.
Figure 13:
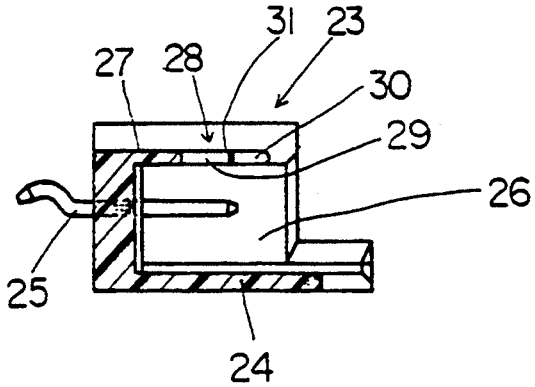
FIG. 13 is a section of the female housing taken along the line 13—13 in FIG. 11.

FIGS. 11 and 14 show another embodiment of a female housing. Female housing 43 has a pair of slotted apertures 29 made in the ceiling plate 27 of the female housing body 24 to mate with a male housing 1 having a pair of latching projections 6. The number and position of locking projections 33A and 33B and slotted apertures 29 in the ceiling plate 27 of a female housing depend upon the number and position of latching projections 6 of an automatic type male housing and the lateral projections 19A and 19B of a non-automatic latching type male housing 10.

As may be understood from the above, a single female housing 23 can be used to mate and lock with both an automatic type male housing 1 and a non-automatic type male housing 10, thus permitting the interchange of male housings with different types of latching systems without changing the female housing. This has the effect of eliminating the need of changing female housings which would be required if a different female housing were used exclusively for each male housing having a different type of latching system. Also, only a single metal mold is prepared to form the female housing which can mate with the two different types of male housings, and, accordingly, the manufacturing and storage costs can be reduced.

It will be understood that the invention may be embodied in other specific forms without departing from the spirit or central characteristics thereof. The present examples and embodiments, therefore, are to be considered in all respects as illustrative and not restrictive, as the invention is not to be limited to the details given herein.

We claim:

1. An electric connector assembly including:

a first connector having a housing with terminals mounted therein;

a second connector having a housing, mateable with said first connector, with terminals mounted therein for mating engagement with the terminals of the first connector, latch means formed on the first connector housing and interengaging latch means formed on said second connector housing, both the latch means and interengaging latch means cooperating with each other to selectively latch said connectors together in a mating relationship, the improvement comprising:

said second connector housing being chosen from a plurality of different housings distinguished from one another in that each respective interengaging latch means of one different housing is different from the interengaging latch means of another different housing, each of said second connector interengaging latch means of said different housings cooperating with the latch means of the first connector housing;

said first connector housing being female and said second connector housing being male with walls of the male connector housing adapted to extend within walls of the female connector housing;

said female connector housing having latch means in the form of both an aperture formed in one of the walls and at least one locking projection formed on one of the walls and said male connector being chosen from two different housings distinguishable from one another in that one housing has interengaging latch means in the form of a latching projection with front and rear slopes adapted to be removably held in said female connector housing aperture and that the other housing has a longitudinal pivoting arm adapted to lock onto the female connector housing locking projection;

a slot being cut into the wall of the female housing through an edge of the aperture to increase the flexibility of the aperture to allow it to more easily flex when in contact with the latch projection; and said aperture being located between a multiple of locking projections.

2. An electrical connector assembly according to claim 1 wherein said pivoting arm has lateral projections which lock onto said multiple locking projections.

3. An electric connector assembly including:

a first connector having a housing with terminals mounted therein;

a second connector having a housing, mateable with said first connector, with terminals mounted therein for mating engagement with the terminals of the first connector, latch means formed on the first connector housing and interengaging latch means formed on said second connector housing, both the latch means and interengaging latch means cooperating with each other to selectively latch said connectors together in a mating relationship, the improvement comprising:

said second connector housing being chosen from a plurality of different housings distinguished from one another in that each respective interengaging latch means of one different housing is different from the interengaging latch means of another different housing, each of said second connector interengaging latch means of said different housings cooperating with the latch means of the first connector housing;

said first connector housing being female and said second connector housing being male with walls of the male connector housing adapted to extend within walls of the female connector housing;

said female connector housing having latch means in the form of both an aperture formed in one of the walls and at least one locking projection formed on one of the walls and said male connector being chosen from two different housings distinguishable from one another in that one housing has interengaging latch means in the form of a latching projection with front and rear slopes adapted to be removably held in said female connector housing aperture and that the other housing has a longitudinal pivoting arm adapted to lock onto the female connector housing locking projection; and said aperture being located between a multiple of locking projections.

4. An electrical connector assembly according to claim 3 wherein said pivoting arm has lateral projections which lock onto said multiple locking projections.

* * * * *